US007077739B2

(12) United States Patent
Kupferberg et al.

(10) Patent No.: US 7,077,739 B2
(45) Date of Patent: Jul. 18, 2006

(54) HIGH VELOCITY AND HIGH DILUTION EXHAUST SYSTEM

(76) Inventors: Minel Kupferberg, 5862 Ferncroft Road, Hampstead, Quebec (CA) H3X 1C7; Marc Robitaille, 860 Helen Road, Gatineau, Quebec (CA) J8M 1M8

( * ) Notice: Subject to any disclaimer, the term of this patent is extended or adjusted under 35 U.S.C. 154(b) by 0 days.

(21) Appl. No.: 10/897,435

(22) Filed: Jul. 23, 2004
(Under 37 CFR 1.47)

(65) Prior Publication Data

US 2006/0019593 A1 Jan. 26, 2006

(51) Int. Cl.
*F23J 11/02* (2006.01)

(52) U.S. Cl. ..... 454/1; 454/40

(58) Field of Classification Search ..... 454/16, 454/1, 39, 40; 110/162
See application file for complete search history.

(56) References Cited

U.S. PATENT DOCUMENTS 94,115 A * 8/1869 Hynes ..... 454/39
126,797 A * 5/1872 Freebom ..... 454/35
1,533,898 A * 4/1925 Prat ..... 110/162
1,770,986 A * 7/1930 Liagre ..... 454/368
2,561,135 A * 7/1951 Resek ..... 110/162
5,439,349 A 8/1995 Kupferberg
6,431,974 B1 * 8/2002 Tetley et al. ..... 454/33
2003/0114098 A1 * 6/2003 Hill et al. ..... 454/16

* cited by examiner

*Primary Examiner*—Gregory Wilson
(74) *Attorney, Agent, or Firm*—Hoffman, Wasson & Gilter, P.C.

(57) ABSTRACT

The high velocity and high dilution exhaust system uses a centrifugal fan provided with a tapered nozzle. The nozzle compresses the airstream exiting the fan to increase back pressure and velocity. The air flow from the fan enters a stack having a venturi further increasing the velocity and decreasing the pressure. The decrease in pressure causes a suction, allowing the introduction of ambient air to mix with and dilute the output of the fan. The total discharge from the exhaust stack has a high velocity resulting in a plume height and effective height of the exhaust before dispersion occurs.

12 Claims, 7 Drawing Sheets

HIGH VELOCITY AND HIGH DILUTION EXHAUST SYSTEM

BACKGROUND OF THE INVENTION

Industrial and institutional processes often produce fumes required to be exhausted and removed from the immediate area of the building. Exhaust systems include ducts, hoods, and exhaust fans to extract the contaminated fumes. Specific applications, such as laboratory or processing exhaust, are hazardous and must be exhausted to insure the safety of those working in close proximity to the source of the exhausted effluent. Safety concerns extend not only to those in the immediate area where the fumes are generated, but also to others located in the building as well as occupants in surrounding buildings.

Improperly designed exhaust systems that ineffectively discharge high concentrations of effluent can result in entrainment of the hazardous or noxious exhaust into the building air conditioning system, contaminating the fresh air brought into the building.

Problems are encountered in particular where the contaminated exhaust is heavier than air, is corrosive or has a foul odor. In these instances it is necessary to displace the exhaust at a height allowing dispersement to negate the possibility of concentration of the effluent at ground level.

In applications where exhaust needs to be displaced high above ground level, exhaust fans and stacks are typically placed on roof tops. To insure the displacement at levels high above ground level, it is known to use long exhaust stacks having an exit orifice at the desired height. Often, the stacks are so long as to be unstable and require the use of guy wires or other braces to ensure their stability, especially if high wind conditions are ever expected.

There is a need in the prior art for an improvement in the design of a fan and stack to deliver fumes to a maximum possible height, before dispersion of the exhaust within the environment occurs to allow complete dissipation and prevent concentration and contamination of the buildings at lower levels.

It is an object of the invention to provide an exhaust fan having a high plume height.

It is another object of the invention to have an exhaust fan having a compact configuration.

It is yet another object of the invention to provide a exhaust fan requiring low energy but having a high exhaust velocity.

It is another object of the invention to provide an exhaust fan allowing dispersement at a height preventing exhaust from reentering a building through an air conditioning system or other roof mounted equipment.

It is still another object of the invention to allow dispersement of exhaust eliminating costly corrosion caused by exhaust vapors.

It is another objective of the invention to provide an exhaust for diluting the exhaust before exiting the exhaust stack.

These and other objects of the invention will become apparent to one of ordinary skill in the art after reviewing disclosure of the invention.

SUMMARY OF THE INVENTION

The high velocity and high dilution exhaust system uses a centrifugal fan provided with a tapered nozzle. The nozzle compresses the airstream exiting the fan to increase back pressure and velocity. The air flow from the fan enters a stack having a venturi further increasing the velocity and decreasing the pressure. The decrease in pressure causes a suction, allowing the introduction of ambient air to mix with and dilute the output of the fan. The total discharge from the exhaust stack has a high velocity resulting in a plume height and effective height of the exhaust before dispersion occurs.

DETAILED DESCRIPTION OF THE INVENTION

Figures 1A, 1B:
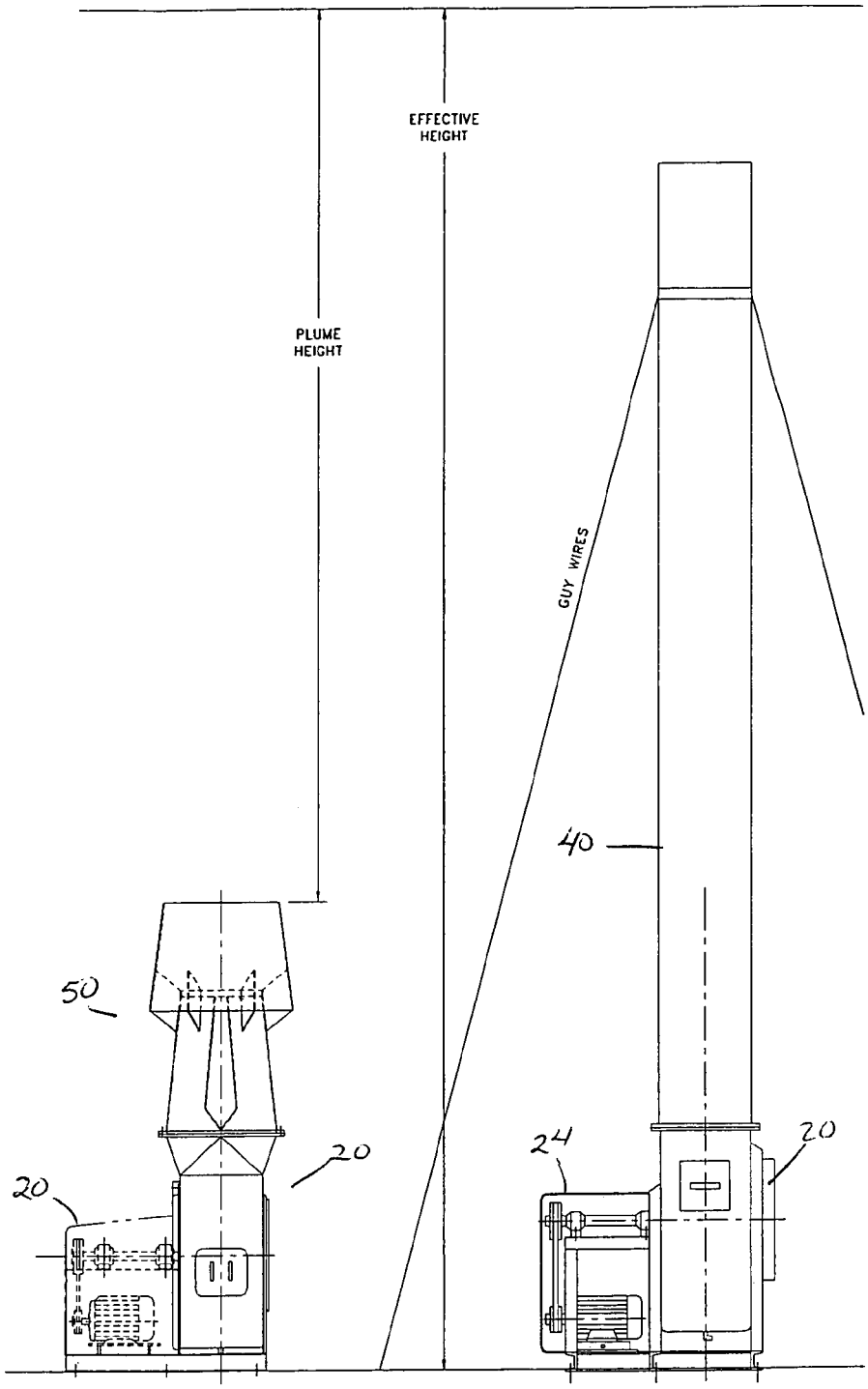
Figure 1a Prior Art
FIG. 1*a* is a end view of a prior art exhaust system.
FIG. 1*b* is a end view of the high velocity and high dilution exhaust system of the invention.

FIG. 1*a* shows a conventional exhaust system, as may be mounted on a roof. The fan 20, such as a centrifugal fan, powered by motor 24, receives exhaust from the ventilation system of the building and sends exhaust through exhaust stack 40. Upon exiting the top of the exhaust stack 40, the exhaust travels a short distance before dissipating within the ambient air. The total distance of the stack and distance traveled before dispersement is shown as the effective height.

FIG. 1*b* shows a centrifugal fan having one of the exhaust stacks usable with the invention. The exhaust leaves the stack 50 with high velocity and stream integrity and has a plume height giving an effective height equal to that of prior art devices having a high stack. The invention has the advantage of diluting the effluent with a compact configuration.

Figure 2:
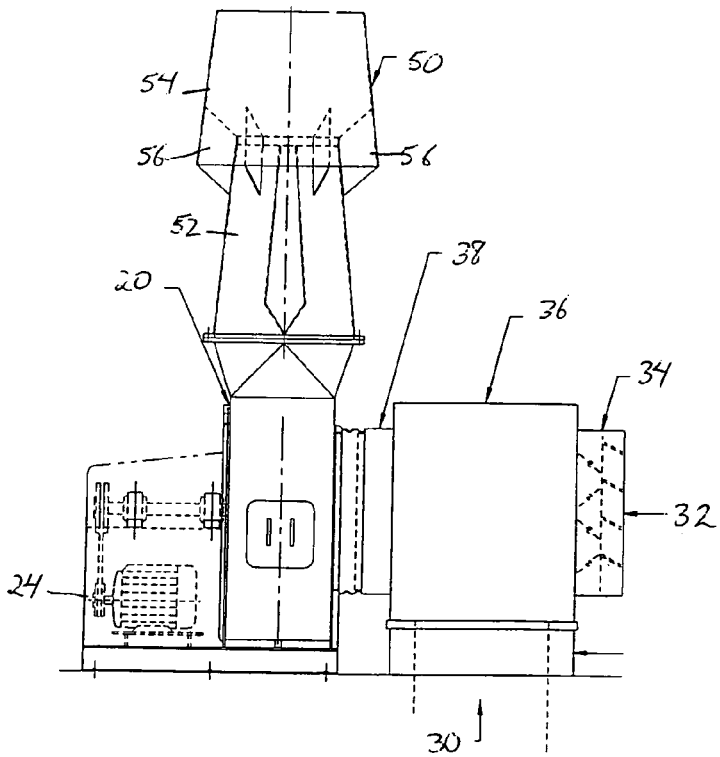
FIG. 2 is a side view of the exhaust system of the invention attached to a plenum.

FIG. 2 shows the centrifugal fan and exhaust stack as part of a ventilation system. Exhaust is received through a duct 30 which terminates at the inlet plenum 36. The inlet plenum 36 is provided with an ambient by-pass 32 having by-pass damper with louver 34. Within the plenum, the exhaust from duct 30 and ambient air through by-pass 32 forms the inlet fan flow which enters centrifugal fan 20 through isolation damper 38. Motor 24 powers centrifugal fan to spin the inlet fan flow and produce pulsed turbulent flow. Fan 20 is provided with a nozzle, to be described later, to stabilize the pulsed turbulent flow exiting the centrifugal fan 20.

Exhaust exiting the fan nozzle enters first stage 52 of the exhaust stack 50. The first stage 52 has an inward taper as the exhaust moves upwardly to the top end. A second stage 54 of the exhaust stack connects to the first stage 52 by struts 56. The spaces between the struts allows the inlet of ambient air as will be described. The exhaust transitioning from the first stage 52 to the second stage 54 exits a small orifice and enters the second stage 54 having a diameter larger than the exit orifice, creating a venturi. Whenever gas flows through a venturi, the narrow portion of venturi causes an increase in velocity and decrease in pressure. The decrease in pressure creates suction causing induced flow of ambient air into the bottom of second stage 54 entering between the struts 56. The result is an exhaust from the top of second stage 54 having high velocity and dilution of the inlet fan flow that entered fan 20 through plenum 36.

Figure 3:
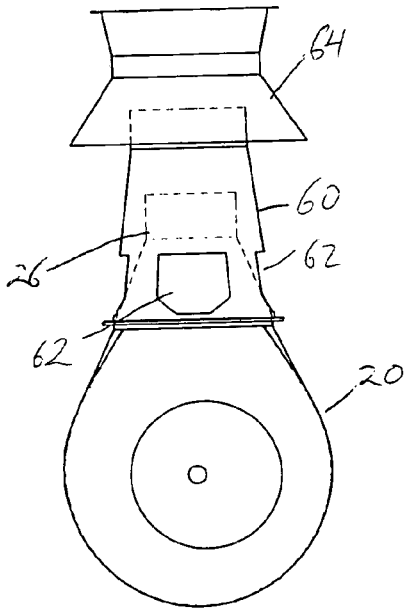
FIG. 3 is a side view of a second centrifugal fan and second embodiment of the exhaust stack.

FIG. 3 shows a second embodiment of an exhaust stack attachable to centrifugal fan 20. Nozzle 26 attached to the fan 20 is shown in phantom, the nozzle 26 having an inward taper to produce an outlet having a smaller diameter. The exhaust is compressed, producing a back pressure stabilizing the pulsed, turbulent flow produced by the fan 20. Exhaust exiting the nozzle 26 enters first stage 60, having a diameter greater than the outlet of the nozzle 26. This causes a venturi effect and induces flow through apertures 62 provided in the first stage 60 below the outlet of the nozzle. This causes dilution of the inlet fan air. The exhaust exits the first stage 60 and enters second stage 64. Second stage 64 has an initial inward taper to a minimum diameter then a slightly outward taper until the outlet. This venturi shape induces a second flow of ambient air entering through the bottom of the second stage 64 to further dilute the effluent. The amount of ambient air added to the exhaust entering the fan is measured as percent dilution. Percent dilution is the amount of ambient air relative to the inlet fan flow present in the exhaust from the top of the exhaust stack. If the same amount of ambient air is added to the inlet fan flow, therefore, there would be 100 percent dilution. Test conducted with this exhaust stack have shown 16 percent dilution.

Figure 4:
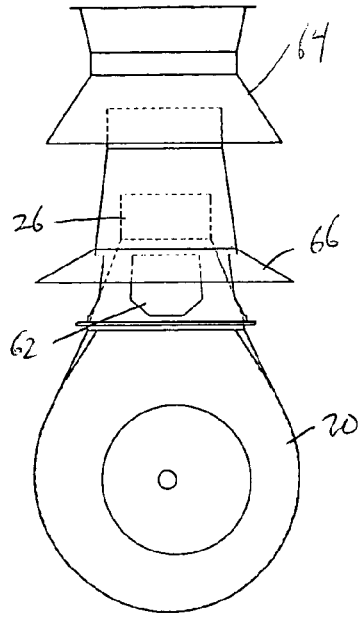
FIG. 4 is a side view of a centrifugal fan having a third embodiment of the exhaust stack.
Figure 5:
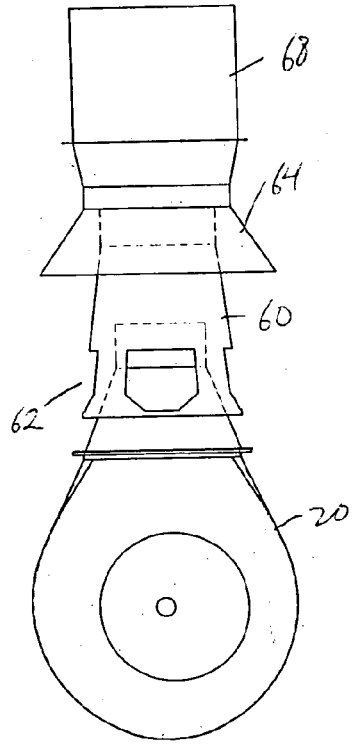
FIG. 5 is a side view of a centrifugal fan having a fourth embodiment of the exhaust stack.

FIG. 4 shows the exhaust stack of FIG. 3 but with the addition of an outwardly extending flange 66 extending from the first stage 60 above the apertures 62. The addition of this flange 66 increases the percent dilution to 20 percent. Likewise, FIG. 5 is similar to the exhaust stack of FIG. 3 but having an additional cylindrical extension 68 extending from second stage 64. This additional height of the exhaust stack grants time and distance for the entrainment of ambient air entering the bottom of the second stage 64. Tests have shown that percent dilution increases to 42 percent for this embodiment.

Figure 6:
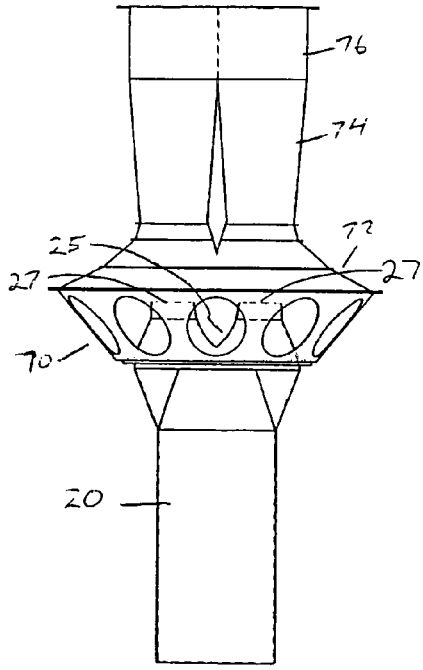
FIG. 6 is an end view of the centrifugal fan and fifth embodiment of the exhaust stack.

FIG. 6 shows another embodiment of the exhaust stack attachable to a centrifugal fan 20. The exhaust has an outwardly flaring flange 70 provided with apertures to allow induced flow and supporting an inwardly extending flange 72 transitioning to a first stage 74 having a slight outwardly taper and joining to a second stage 76. The venturi effect created by the inwardly extending flange 72 and outwardly tapering first stage 74, induces flow of ambient air through the apertures in the outwardly extending flange 70 to dilute the exhaust coming through the nozzle of the centrifugal fan 20. Tests have shown 40 percent dilution.

In this embodiment, the nozzle of the centrifugal fan is provided with a nozzle cap. As seen in FIG. 6, the nozzle cap has a solid central U-shaped trough extending across the opening forming two exit apertures 27. The result is to reduce the volume of the exhaust plume exiting the centrifugal fan while maximizing the surface area. It is at the boundary of the fast moving exhaust stream and ambient air within the exhaust stack that drags the ambient air and induces flow through apertures in the outwardly extending flange 70.

Figure 7:
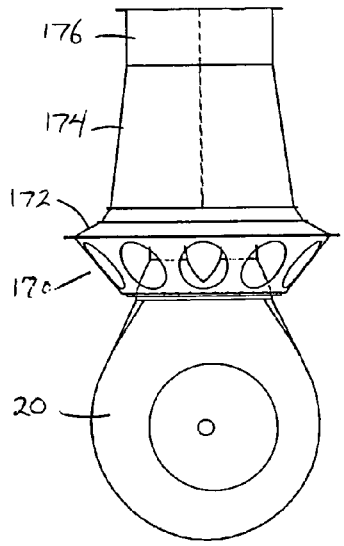
FIG. 7 is an side view of a centrifugal fan and a sixth embodiment of the exhaust stack.

FIG. 7 shows another embodiment of the exhaust stack having an outwardly extending apertured flange 170 attached to the fan and supporting an inwardly extending flange 172. A first stage 174 attaches to the inwardly extending flange and has a slight inward taper at a rate much less than the inward taper of the flange 172. Extending from the first stage 174 is a cylindrical second stage 176. The thin nozzle has the same nozzle cap used in the embodiment of FIG. 6 and tests have shown a 58 percent dilution percent.

Figure 7A:
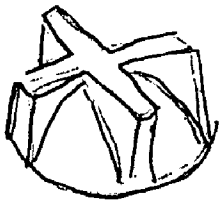
FIG. 7*a* is a view of an alternative nozzle cap useable with the exhaust system of FIG. 7.

FIG. 7*a* shows a second type of nozzle cap that may be used with the embodiment of FIG. 7. This nozzle cap has a cross-shaped aperture reducing the volume of the plume exiting the nozzle while trying to maximize the surface area to induce flow of ambient air into the exhaust stack through the apertured flange 170. By changing the configuration of the nozzle cap, tests have shown an increase in dilution percent to 75 percent.

Figure 7B:
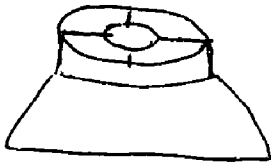
FIG. 7*b* is a view of an alternative nozzle cap useable with the exhaust system of FIG. 7.

FIG. 7*b* shows a third type of nozzle useable with the exhaust stack of FIG. 7. This nozzle has a central plug attached to the perimeter of the nozzle cap by struts. Test with this nozzle cap have shown a dilution of 55 percent.

Figure 7C:
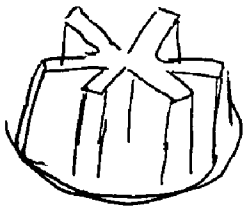
FIG. 7*c* is a view of an alternative nozzle cap useable with the exhaust system of FIG. 7.

FIG. 7*c* shows a fourth type of nozzle useable with the embodiment of FIG. 7 having a six vein cross rather than a four veined cross shown in FIG. 7*a*. Tests with this type of nozzle cap have shown a dilution of 61 percent.

Figure 8:
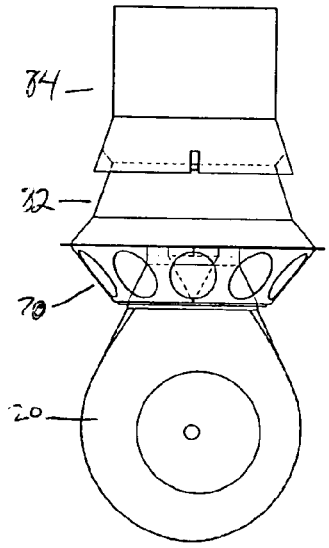
FIG. 8 is a side view of a centrifugal fan and a seventh embodiment of the exhaust stack.

FIG. 8 shows another embodiment of the exhaust stack attachable to a centrifugal fan 20 having the outwardly tapering apertured flange 70 with a first stage 82 having a first section attached to and extending upwardly from the apertured flange 70 and a second section having a slightly smaller taper. Attached to the first stage is second stage 84 having a first inwardly tapering section, having the same taper as the second section of the first stage, and a second cylindrical section. Each of the first and second stages has a venturi effect inducing flow through the aperture flange 70 and from underneath the second stage 84, respectively.

The embodiment shown in FIG. 8 has a nozzle cap with a central conical plug and test have shown a dilution of 76 percent. Replacing this nozzle cap with the cross shaped nozzle cap of FIG. 7*a* has shown dilution of 105 percent.

Figure 9:
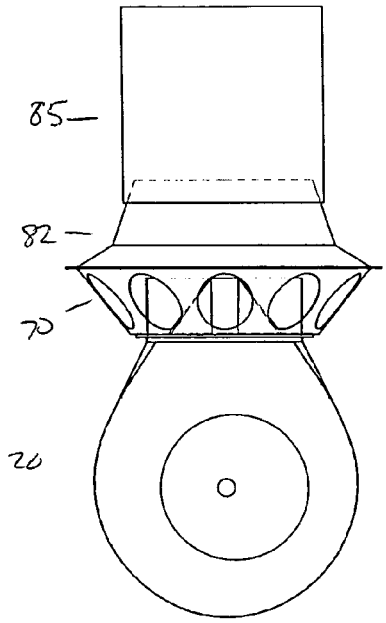
FIG. 9 is a side view of a centrifugal fan and an eighth embodiment of the exhaust stack.

FIG. 9 shows an embodiment similar to FIG. 8 but having a second stage 85 which is a simple cylinder extending upwardly from the first stage 82. This embodiment has shown dilution of 92 percent in tests.

Figure 10:
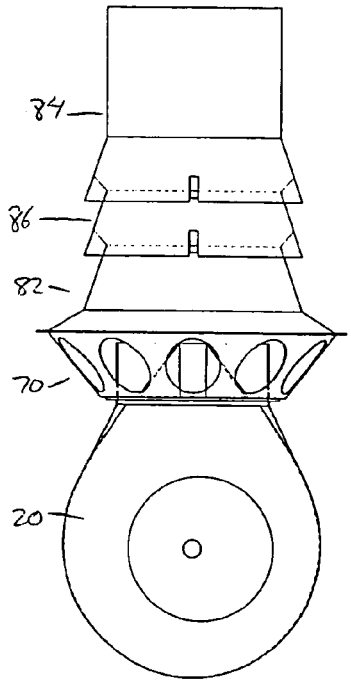
FIG. 10 is a side view of a centrifugal fan and ninth embodiment of the exhaust stack.

FIG. 10 is similar to FIG. 8 but having the addition of an intermediate stage 86 between the first stage 82 and second stage 84. The intermediate stage 86 is a short conical piece having the same taper as the second section of the first stage and the bottom section of the second stage. Induced flow can enter the exhaust stack from the space underneath the intermediate stage. This stack has shown a 105 percent dilution.

Figure 11:
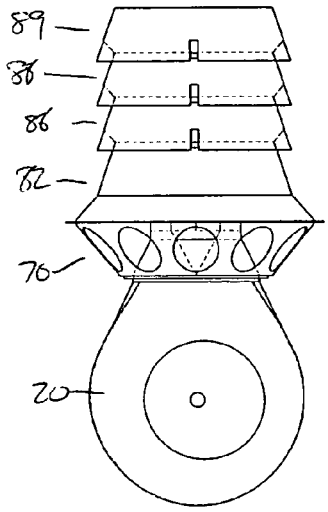
FIG. 11 is a side view of the centrifugal fan with a tenth embodiment of the exhaust stack.

FIG. 11 shows a embodiment having the first stage 82 and intermediate stage 86. However, in this embodiment the second stage is replaced with two additional stages identical to the intermediate stage. Flow can be induced through the apertured flange 70 and underneath each of the stages 86, 88, 89 above the first stage. Tests have shown an 86 percent dilution with this output stack.

Each of the embodiments uses the venturi effect within the exhaust stack to induce flow of ambient air and increase velocity. Needless to say, increased dilution increases the mass air flow exiting the exhaust stack. The greater the mass air flow, the lower the velocity due to the greater weight of the exhaust being moved. With the various configurations of the exhaust stack, an appropriate dilution rate and exhaust speed can be chosen for any application. The result is an exhaust that has a greater plume height than prior art devices enabling dispersion of exhaust from a compact low energy configuration.

While the invention has been described with reference to preferred embodiment, various variations and modifications would be apparent to one of ordinary skill in the art. The invention encompasses such variations and modifications. The stacks may be used with any type of fan, such as centrifugal, a belt driven axial fan or a direct drive axial fan.

We claim:

1. An exhaust system, comprising a fan, an exhaust stack having a venturi, and a first set of apertures in said exhaust stack said exhaust stack has a first stage and a second stage, said first stage having an inlet and an outlet, said outlet with a smaller diameter than said inlet, said second stage overlapping said first stage, said venturi formed by the outlet of said first stage and said second stage, and said first set of apertures formed between said first and second stage for allowing ambient air to mix with exhaust from said fan.

2. The exhaust system of claim 1, further comprising a nozzle on said fan, said nozzle having an outlet, said first stage fitting over said nozzle, said first stage having a diameter greater than said nozzle to create a second venturi, a second set of apertures formed in said first stage below the level of said nozzle outlet.

3. The exhaust system of claim 2, further comprising a flange extending outwardly from said first stage located above said first set of apertures.

4. The exhaust system of claim 2, further comprising a nozzle cap on said nozzle outlet, said nozzle cap further restricting the opening for exhaust from said fan.

5. The exhaust system of claim 4, wherein said nozzle cap has a cross-shaped opening.

6. The exhaust system of claim 1, wherein said second stage has an inwardly tapering section connected to an outwardly connecting section.

7. The exhaust system of claim 6, further comprising a cylindrical section extending above said second stage.

8. The exhaust system of claim 1, further comprising an outwardly extending flange extending between the centrifugal fan on the inlet of said first stage.

9. The exhaust system of claim 8, further comprising a second set of apertures in said outwardly extending flange.

10. The exhaust system of claim 9, wherein said first stage tapers inwardly from an inlet to an outlet.

11. The exhaust system of claim 9, wherein said second stage is cylindrical.

12. The exhaust system of claim 1, wherein said fan is a centrifugal fan.

* * * * *